US005326209A

United States Patent [19]

Duke

[11] Patent Number: 5,326,209

[45] Date of Patent: Jul. 5, 1994

[54] METHOD AND AN APPARATUS FOR FORMING A PLURALITY OF INDIVIDUAL BOOKS IN A PREDETERMINED SEQUENCE

[75] Inventor: B. Michael Duke, Clayton, Ohio

[73] Assignee: AM International, Inc., Chicago, Ill.

[21] Appl. No.: 971,288

[22] Filed: Nov. 4, 1992

[51] Int. Cl.[5] ..... B42C 1/00; B65H 43/02

[52] U.S. Cl. ..... 412/1; 412/11; 412/13; 412/14; 270/54; 270/56; 198/347.1

[58] Field of Search ..... 412/1, 11, 12, 13, 14; 270/54, 55, 56, 57, 58; 198/347.1

[56] References Cited

U.S. PATENT DOCUMENTS

| | | | |
|---|---|---|---|
| 5,011,123 | 4/1991 | Vigano | 270/54 |
| 5,098,076 | 3/1992 | Kelsey | 198/347.1 X |
| 5,135,211 | 8/1992 | Barnebey | 270/54 |
| 5,143,362 | 9/1992 | Doane et al. | 270/54 X |
| 5,144,562 | 9/1992 | Stikkelorum et al. | 270/54 X |

*Primary Examiner*—Mark Rosenbaum
*Assistant Examiner*—S. Thomas Hughes
*Attorney, Agent, or Firm*—Tarolli, Sundheim & Covell

[57] ABSTRACT

An apparatus for forming a plurality of individual books in a predetermined sequence includes a main conveyor having a plurality of spaced collating stations for receiving signatures. A plurality of feeders selectively feed signatures to the spaced collating stations as the main conveyor moves the plurality of spaced collating stations past the plurality of feeders to form the plurality of individual books in the predetermined sequence. A rejector rejects a defective book from the sequence of books leaving a space in the sequence of books. A reorderer causes the plurality of feeders to rebuild the rejected book. A first transferor transfers the sequence of books to a second conveyor to convey the sequence of books away from the main conveyor. The first transfer means is inhibited from transferring the reordered book from the main conveyor to the second conveyor. A second transferor transfers the reordered book to the second conveyor downstream from the first transferor and into the space in the sequence of books where the defective book was rejected from so that the books are in the predetermined sequence.

19 Claims, 2 Drawing Sheets

METHOD AND AN APPARATUS FOR FORMING A PLURALITY OF INDIVIDUAL BOOKS IN A PREDETERMINED SEQUENCE

BACKGROUND OF THE INVENTION

The present invention relates to a method and an apparatus for forming a plurality of individual books in a predetermined sequence, and more specifically, to an apparatus which forms individual books in a predetermined sequence and which rejects and reorders a defective book and puts the reordered book into the sequence of books in the space the defective book was rejected from.

A known apparatus for forming a plurality of individual books in a predetermined sequence is disclosed in U.S. Pat. No. 5,098,076. In U.S. Pat. No. 5,098,076 a main conveyor with a plurality of spaced collating stations receives signatures. A plurality of feeders selectively feed signatures to the spaced collating stations to form the plurality of individual books in the predetermined sequence. A reject means rejects a defective book from the sequence of books leaving a space in the sequence of books. A reorder means causes the plurality of feeders to properly rebuild a rejected book upstream of the space where the book was rejected, such that the reordered book is out of sequence.

A first transfer means transfers the sequence of books from the main conveyor to an accumulator means. When the reordered book is conveyed to the first transfer means, the first transfer means is inhibited and does not transfer the reordered book to the accumulator means. The accumulator means conveys the sequence of books away from the main conveyor and back to the main conveyor to bypass a portion of the main conveyor on which the reordered book is conveyed. The accumulator means transfers the sequence of books back to the main conveyor system so that the reordered book is in the space in the sequence of books where the defective book was rejected from so that the books are in the predetermined sequence.

SUMMARY OF THE INVENTION

The present invention provides a new and improved apparatus for forming a plurality of individual books in a predetermined sequence. The apparatus comprises a main conveyor having a plurality of spaced collating stations for receiving signatures. A plurality of feeders selectively feed signatures to the spaced collating stations as the main conveyor moves the plurality of spaced stations past the feeders to form the plurality of individual books in the predetermined sequence. A reject means rejects a defective book from the sequence of books leaving a space in the sequence of books. A reorder means causes the plurality of feeders to rebuild the rejected book upstream of the space where the book was rejected from so that the reordered book is out of sequence. A first transfer means transfers the sequence of books to a second conveyor for conveying the sequence of books away from the main conveyor and to a mailing table. When the reordered book is conveyed to the first transfer means, the first transfer means is inhibited and does not transfer the reordered book to the second conveyor. The reordered book is conveyed to a second transfer means that transfers the reordered book to the second conveyor and into the space in the sequence of books where the defective book was rejected from so that the books are in the predetermined sequence.

BRIEF DESCRIPTION OF THE DRAWINGS

The foregoing and other features of the present invention will become more apparent to one skilled in the art upon reading the following description of the present invention with reference to the accompanying drawings, wherein.

DESCRIPTION OF A PREFERRED EMBODIMENT

Figure 1:
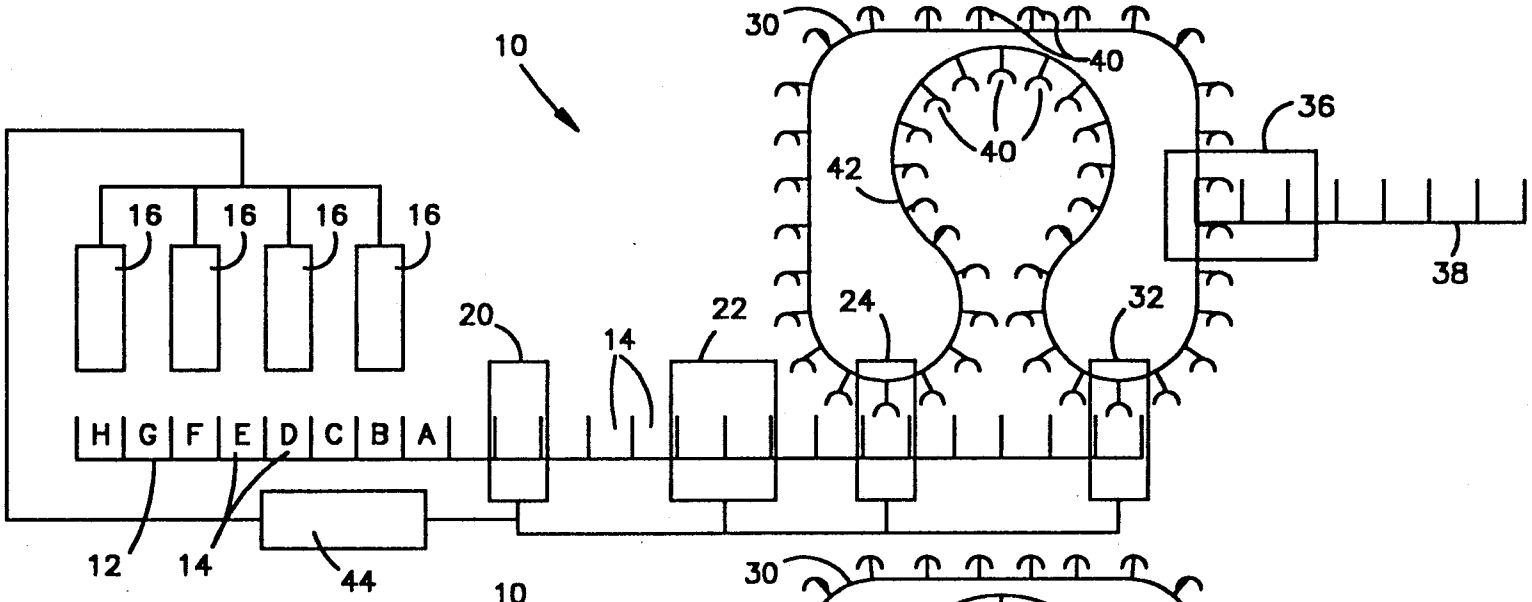
FIG. 1 is a schematic illustration of an apparatus forming a plurality of individual books in a predetermined sequence.

An apparatus 10 (FIG. 1) for forming a plurality of individual books, such as A, B, C, etc., in a predetermined sequence includes a main conveyor system 12. The main conveyor 12 has a plurality of spaced collating stations 14 for receiving signatures to form the plurality of individual books A, B, C, etc.. A plurality of feeders 16 are operable to selectively feed signatures to the spaced collating stations 14 to form the plurality of individual books A, B, C, etc.. Although four such feeders 16 are shown in the figures, it is contemplated that any number of feeders could be used, depending on the number of signatures to be fed to form a book.

The main conveyor 12 conveys the sequence of books through a reject means 20 after the books have been formed. The reject means 20 rejects a defectively formed book to leave a space in the sequence of books. The reject means 20 rejects a defective book in response to a signal detecting a defective book in any known manner. Preferably, the reject means 20 rejects a book in response to a signal from one of a plurality of sensors located on the feeders 16 that sense whether signatures are properly fed from the feeders. For example, the sensors would sense if a signature that was to be fed was not fed.

The main conveyor system 12 transfers the books through a binder 22. The binder 22 forms the plurality of signatures in each spaced collating station into a book in any known way.

A first switch 24 transfers books from the main conveyor 12 to a gripper conveyor 30. The switch 24 also senses an empty collating station 14 where a book was rejected from. When an empty collating station 14 arrives at the switch 24, the switch 24 sends a signal to reorder the book that was rejected.

A second switch 32 transfers reordered books to the gripper conveyor 30. The switch 24 is inhibited from transferring a reordered book to the gripper conveyor 30. The main conveyor 12 conveys a reordered book past the switch 24 to the switch 32 where the reordered book is transferred to the gripper conveyor 30. The gripper conveyor 30 conveys the books from the main conveyor 12 to a transfer means 36. The transfer means 36 transfers the books from the gripper conveyor 30 to a conveyor 38. The conveyor 38 conveys the books in sequence to a mail table for printing of addresses on the books and further processing.

The gripper conveyor 30 includes a plurality of grippers 40 and runs at the same speed as the main conveyor 12. The gripper conveyor 30 conveys the plurality of grippers 40 through a repair loop 42 that extends between the switch 24 and the switch 32. The number of grippers 40 in the repair loop 42 is equal to the number of spaced collating stations 14 that are included between the switch 32 and the first feeder 16. Therefore, a reordered book and the empty gripper 40 that was at the switch 24 when the book was reordered reach the switch 32 at the same time.

An electronic control unit or computer 44 controls the operation of the apparatus 10. The control unit 44 sends signals to the feeders 16 to control the selective feeding of signatures to the spaced collating stations 14. The electronic control unit 44 controls the reject means to reject a defective book from the sequence of books in response to a signal from a sensor detecting a defective book. The electronic control unit 44 controls the switches 24 and 32 to feed the books to the gripper conveyor 30.

Figure 2:
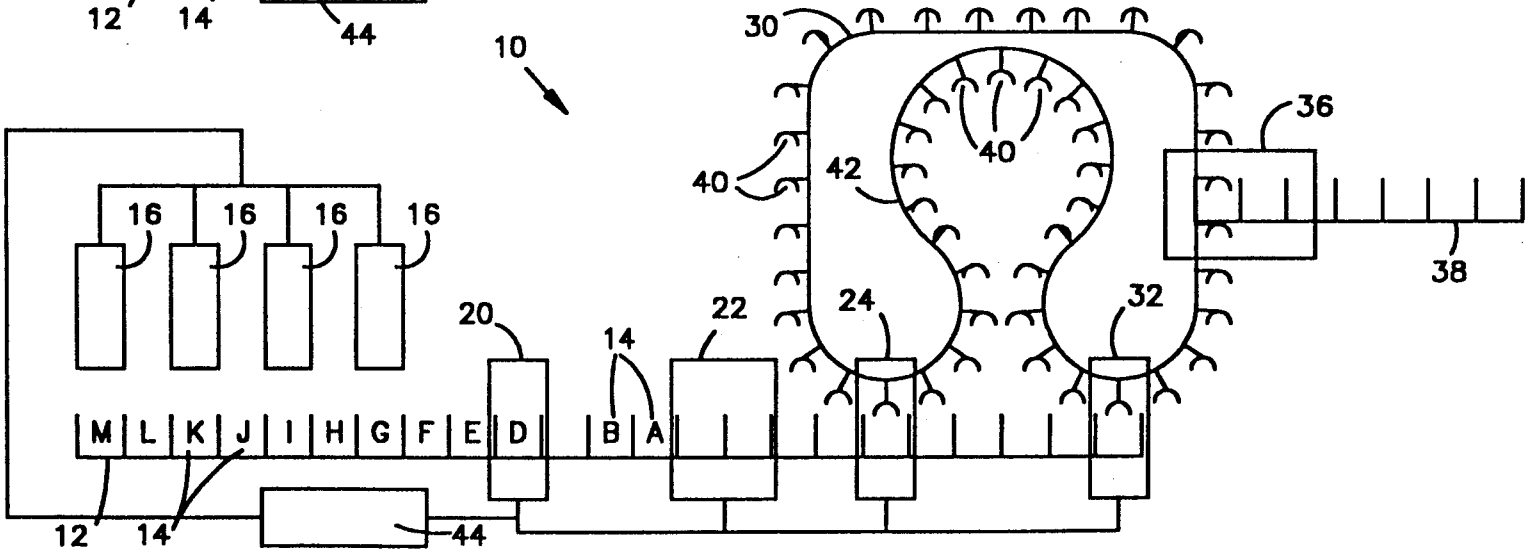
FIGS. 2–4 further show the apparatus of FIG. 1 forming the plurality of individual books in a predetermined sequence.

The electronic control unit 44 controls the feeders 16 to selectively feed signatures to the spaced collating stations 14 to form a plurality of individual books such as A, B, C, etc., in a predetermined sequence (FIG. 1). In a preferred embodiment, the feeders 16 include sensors for sensing the defective feeding of signatures. When a sensor detects the misfeeding of a signature, a signal is sent from the feeder 16 to the electronic control unit 44 so that the electronic control unit 44 can activate the reject means 20 to reject the defective book when the defective book reaches the reject means. A defective book, such as C, (FIG. 2) is rejected by the reject means 20 from the sequence of the plurality of books. Since the book C is rejected from its spaced collating station 14, a space between book B and book D is left in the predetermined sequence of books.

Figure 3:
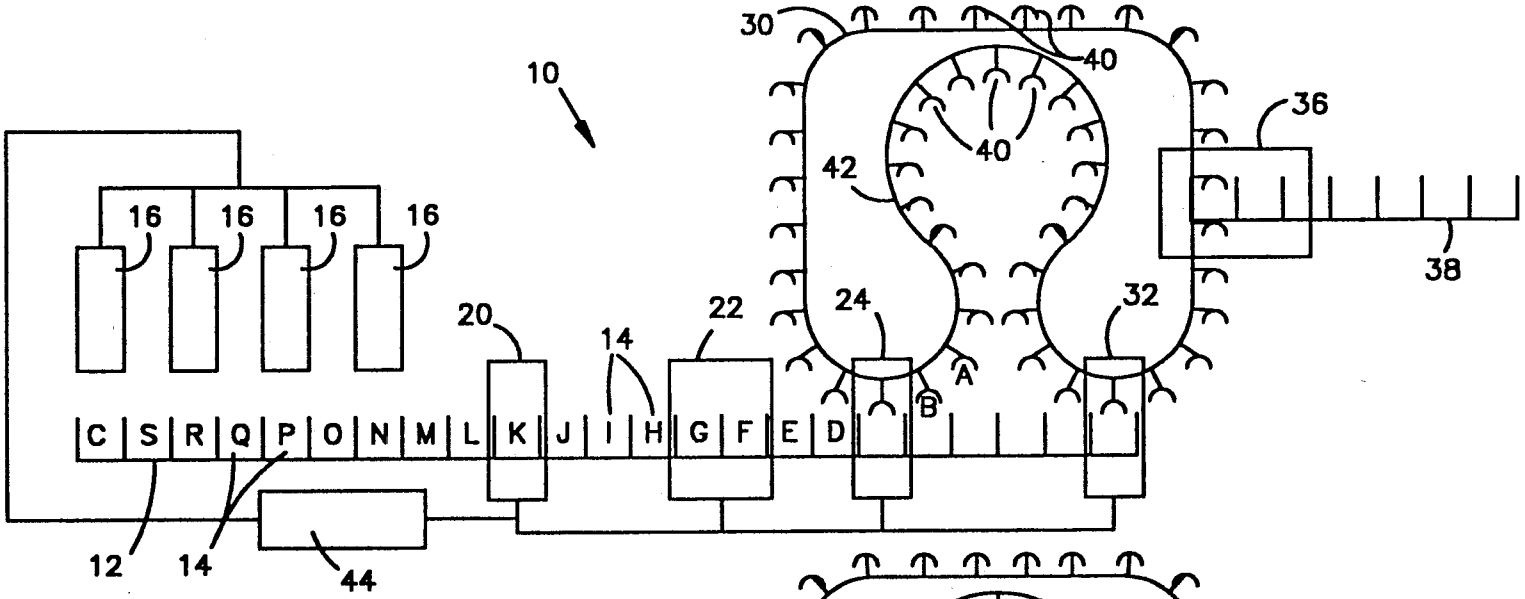

When the books reach the switch 24, the books are transferred to the gripper conveyor 30 (FIG. 3). When the space where a rejected book, such as book C, reaches the switch 24, the switch 24 sends a signal to the electronic control unit 44. The electronic control unit 44 sends a signal to the feeders 16 in response to the signal from the switch 24 to immediately begin selectively feeding signatures to the next available spaced collating station 14 and rebuild the book C. The book C is therefore out of sequence because it is after book S, for example, (see FIG. 3) and not between books B and D. When the space where the defective book was rejected from reaches the switch 24, a book is not transferred to the gripper conveyor 30 and an empty gripper 40 goes around the repair loop 42.

Figure 4:
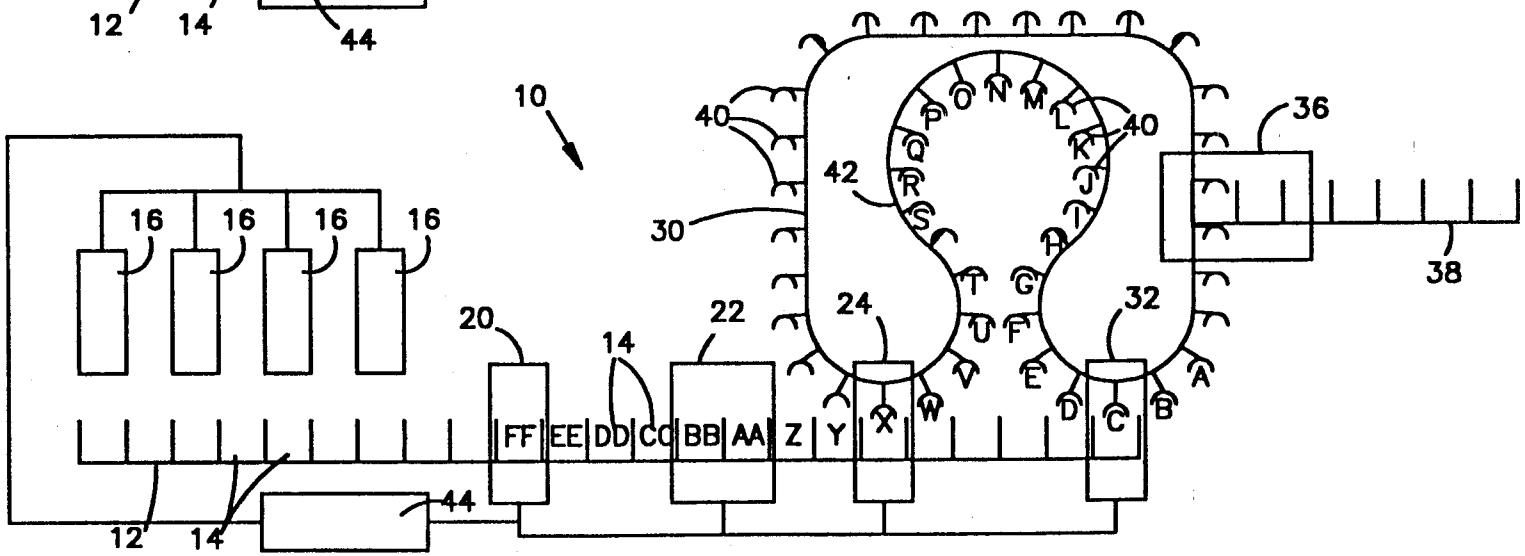

When the reordered book C reaches the switch 24, the electronic control unit 44 inhibits the switch 24. The reordered book C is thus not transferred to the gripper conveyor 30 and a space is left between books S and T (see FIG. 4). The main conveyor 12 conveys the reordered book C to the switch 32 (FIG. 4). The switch 32 transfers the reordered book C into the empty gripper between books B and D so that the books are in their predetermined sequence when they reach the mail table.

From the above description of a preferred embodiment of the invention, those skilled in the art will perceive improvements, changes and modifications in the present invention. Such improvements, changes and modifications within the skill of the art are intended to be covered by the appended claims.

Having described the invention, the following is claimed:

1. An apparatus for forming a plurality of individual books in a predetermined sequence, said apparatus comprising:

a main conveyor system having a plurality of spaced collating stations for receiving signatures;

a plurality of feeders for selectively feeding signatures to said spaced collating stations as said main conveyor system moves said plurality of spaced collating stations past said plurality of feeders to form the plurality of individual books in the predetermined sequence;

a reject means for rejecting a defective book from the sequence of books and leaving a space in the sequence of books;

a reorder means for causing said plurality of feeders to form a book that corresponds in sequence to the defective book;

a second conveyor for conveying the sequence of books away from said main conveyor system;

a first transfer means for transferring the sequence of books to said second conveyor; and a second transfer means for transferring the book that corresponds in sequence to the defective book to said second conveyor downstream from said first transfer means and into the space in the sequence of books where the defective book was rejected from so that the books are in the predetermined sequence.

2. An apparatus as set forth in claim 1 wherein said first transfer means in inhibited from transferring the book that corresponds in sequence to the defective book from said main conveyor system to said second conveyor.

3. An apparatus as set forth in claim 1 wherein said main conveyor system conveys the books through a binding mechanism for binding the books.

4. An apparatus as set forth in claim 1 wherein said second conveyor comprises a loop section, said first transfer means transferring the books to said second conveyor at the beginning of said loop section and said second transfer means transferring the book that corresponds in sequence to the defective book to said second conveyor at the end of said loop section.

5. An apparatus for forming a plurality of individual books in a predetermined sequence, said apparatus comprising:

a main conveyor system having a plurality of spaced collating stations for receiving signatures;

a plurality of feeders for selectively feeding signatures to said spaced collating stations as said main conveyor system moves said plurality of spaced collating stations past said plurality of feeders to form the plurality of individual books in the predetermined sequence;

a gripper conveyor for conveying the plurality of books away from said main conveyor system, said gripper conveyor having a repair loop section;

a first transfer means for transferring the plurality of books to said gripper conveyor upstream of said repair loop section; and a second transfer means for transferring an out-of-sequence book to said gripper conveyor downstream of said repair loop section so that the books are in the predetermined sequence.

6. An apparatus as set forth in claim 5 wherein said first transfer means is inhibited from transferring the out-of-sequence book to said gripper conveyor.

7. An apparatus as set forth in claim 5 further including reject means along said main conveyor system for rejecting a defective book from the sequence of books.

8. An apparatus as set forth in claim 7 further including reorder means for causing said plurality of feeders to form a book that corresponds in sequence to the defective book and out of the predetermined sequence.

9. A method for forming a plurality of individual books in a predetermined sequence comprising the steps of:

moving a plurality of spaced collating stations past a plurality of feeders;

selectively feeding signatures to the spaced collating stations as the plurality of spaced collating stations move past the plurality of feeders to form the plurality of individual books in the predetermined sequence;

rejecting a defective book from the sequence of books and leaving a space in the sequence of books;

causing said plurality of feeders to form a book that corresponds in sequence to the defective book;

transferring the sequence of books from the spaced collating stations to a conveyor for conveying the sequence of books away from the spaced collating stations; and transferring the book that corresponds in sequence to the defective book from the spaced collating stations to the conveyor downstream from where the sequence of books is transferred to the conveyor and into the space in the sequence of books where the defective book was rejected from so that the books are in the predetermined sequence.

10. A method as set forth in claim 9 further including the step of preventing the transfer of the book that corresponds in sequence to the defective book from the place where the sequence of books is transferred to the conveyor.

11. A method for forming a plurality of individual books in a predetermined sequence comprising the steps of:

moving a plurality of spaced collating stations past a plurality of feeders;

selectively feeding signatures to the spaced collating stations as the plurality of spaced collating stations moves past the plurality of feeders to form the plurality of individual books in the predetermined sequence;

transferring the plurality of books to a gripper conveyor for conveying the plurality of books away from the spaced collating stations upstream of a repair loop section of the gripper conveyor; and transferring an out-of-sequence book to the gripper conveyor downstream of the repair loop section so that the books are in the predetermined sequence.

12. A method as set forth in claim 11 further including the step of rejecting a defective book from the sequence of books.

13. A method as set forth in claim 12 further including the step of causing the plurality of feeders to form a book that corresponds in sequence to the defective book and out of the predetermined sequence.

14. An apparatus for forming a plurality of individual books in a predetermined sequence, said apparatus comprising:

a main conveyor system having a plurality of spaced collating stations for receiving signatures;

a plurality of feeders for selectively feeding signatures to said spaced collating stations as said main conveyor system moves said plurality of spaced collating stations past said plurality of feeders to form the plurality of individual books in the predetermined sequence;

a reject means for rejecting a defective book from the sequence of books and leaving a space in the sequence of books;

a reorder means for causing said plurality of feeders to form a book that corresponds in sequence to the defective book;

a second conveyor for conveying the sequence of books away from said main conveyor system;

a first transfer means for transferring the sequence of books to said second conveyor; and a second transfer means for transferring the book that corresponds in sequence to the defective book to said second conveyor downstream from said first transfer means and into the space in the sequence of books where the defective book was rejected from so that the books are in the predetermined sequence;

a portion of said second conveyor extending from said first transfer means to said second transfer means including a plurality of spaced stations for receiving the books, the number of said plurality of spaced stations being at least equal to the number of said plurality of collating stations along said main conveyor system from the first of said plurality of feeders to said second transfer means.

15. An apparatus for forming a plurality of individual books in a predetermined sequence, said apparatus comprising:

a main conveyor system having a plurality of spaced collating stations for receiving signatures;

a plurality of feeders for selectively feeding signatures to said spaced collating stations as said main conveyor moves said plurality of spaced collating stations past said plurality of feeders to form the plurality of individual books in the predetermined sequence;

a reject means for rejecting a defective book from the sequence of books and leaving a space in the sequence of books;

a reorder means for causing said plurality of feeders to form a book that corresponds in sequence to the defective book;

a second conveyor for conveying the sequence of books away from said main conveyor system;

a first transfer means for transferring the sequence of books to said second conveyor; and a second transfer means for transferring the book that corresponds in sequence to the defective book to said second conveyor downstream from said first transfer means and into the space in the sequence of books where the defective book was rejected from so that the books are in the predetermined sequence;

said reorder means causing said plurality of feeders to form the book that corresponds in sequence to the defective book when the space in the sequence of books where the defective book was rejected from reaches said first transfer means.

16. An apparatus for forming a plurality of individual books in a predetermined sequence, said apparatus comprising:

a main conveyor system having a plurality of spaced collating stations for receiving signatures;

a plurality of feeders for selectively feeding signatures to said spaced collating stations as said main conveyor system moves said plurality of spaced collating stations past said plurality of feeders to form the plurality of individual books in the predetermined sequence;

a gripper conveyor for conveying the plurality of books away from said main conveyor system, said gripper conveyor having a repair loop section;

a first transfer means for transferring the plurality of books to said gripper conveyor upstream of said repair loop section; and a second transfer means for transferring an out-of-sequence book to said gripper conveyor downstream of said repair loop section so that the books are in the predetermined sequence;

said gripper conveyor including a plurality of grippers along said repair loop section, the number of said plurality of grippers being at least equal to the number of said plurality of spaced collating stations along said conveyor system from the first of said plurality of feeders to said second transfer means.

17. A method for forming a plurality of individual books in a predetermined sequence comprising the steps of:

moving a plurality of spaced collating stations past a plurality of feeders;

selectively feeding signatures of the spaced collating stations as the plurality of spaced collating stations move past the plurality of feeders to form the plurality of individual books in the predetermined sequence;

rejecting a defective book from the sequence of books and leaving a space in the sequence of books;

causing said plurality of feeders to form a book that corresponds in sequence to the defective book;

transferring the sequence of books from the spaced collating stations to a conveyor for conveying the sequence of books away from the spaced collating stations;

transferring the book that corresponds in sequence to the defective book from the spaced collating stations to the conveyor downstream from where the sequence of books is transferred to the conveyor and into the space in the sequence of books where the defective book was rejected from so that the books are in the predetermined sequence;

providing the conveyor with a number of spaced stations for receiving the books between the place where the sequence of books is transferred to the conveyor and the place where the book that corresponds in sequence to the defective book is transferred to the conveyor; and providing the same number of spaced collating stations extending from the first of the plurality of feeders to the place where the book that corresponds in sequence to the defective book is transferred to the conveyor.

18. A method of forming a plurality of individual books in a predetermined sequence comprising the steps of:

moving a plurality of spaced collating stations past a plurality of feeders;

selectively feeding signatures to the spaced collating stations as the plurality of spaced collating stations move past the plurality of feeders to form the plurality of individual books in the predetermined sequence;

rejecting a defective book from the sequence of books and leaving a space in the sequence of books;

causing said plurality of feeders to form a book that corresponds in sequence to the defective book;

transferring the sequence of books from the spaced collating stations to a conveyor for conveying the sequence of books away from the spaced collating stations; and transferring the book that corresponds in sequence to the defective book from the spaced collating stations to the conveyor downstream from where the sequence of books is transferred to the conveyor and into the space in the sequence of books where the defective book was rejected from so that the books are in the predetermined sequence;

said step of causing the plurality of feeders to form the book that correspond in sequence to the defective book including reordering the defective book when the space in the sequence of books where the defective book was rejected from reaches the place where the sequence of books is transferred to the conveyor.

19. A method for forming a plurality of individual books in a predetermined sequence comprising the steps of:

moving a plurality of spaced collating stations past a plurality of feeders;

selectively feeding signatures to the spaced collating stations as the plurality of spaced collating stations moves past the plurality of feeders to form the plurality of individual books in the predetermined sequence;

transferring the plurality of books to a gripper conveyor for conveying the plurality of books away from the spaced collating stations upstream of a repair loop section of the gripper conveyor;

transferring an out-of-sequence book to the gripper conveyor downstream of the repair loop section so that the books are in the predetermined sequence; and providing the gripper conveyor with a number of grippers along the repair loop section and providing the same number of spaced collating stations between the first of the plurality of feeders and the place where the out-of-sequence book is transferred to the gripper conveyor.

* * * * *